United States Patent [19]

Duda

[11] Patent Number: 4,853,679

[45] Date of Patent: Aug. 1, 1989

[54] METHOD AND APPARATUS FOR DETECTING SURFACE DISCONTINUITIES

[76] Inventor: Stanislaw K. Duda, 205 Pavonia Ave., Jersey City, N.J. 07302

[21] Appl. No.: 176,424

[22] Filed: Apr. 1, 1988

[51] Int. Cl.[4] ..... G08B 21/00

[52] U.S. Cl. ..... 340/675; 26/70; 226/24

[58] Field of Search ..... 340/675; 26/70, 51.4; 226/24, 44

[56] References Cited

U.S. PATENT DOCUMENTS

| | | | |
|---|---|---|---|
| 2,637,115 | 5/1953 | Watson | 116/303 |
| 3,081,958 | 3/1963 | Kegg | 340/675 |
| 3,182,147 | 4/1965 | Larson | 340/675 |
| 3,182,536 | 5/1965 | Sumpter, Jr. et al. | 226/45 |
| 3,553,668 | 1/1971 | Urmenyi | 340/678 |
| 4,063,051 | 12/1977 | Gundlach et al. | 340/675 |
| 4,187,132 | 2/1980 | Dijk et al. | 226/45 |
| 4,364,502 | 12/1982 | Frentess | 226/45 |
| 4,375,175 | 3/1983 | Elsas et al. | 26/51.4 |
| 4,493,234 | 1/1985 | Ziegler et al. | 26/51.4 |

*Primary Examiner*—Glen R. Swann, III

*Attorney, Agent, or Firm*—William E. Pelton; Bruce L. Adams; Van C. Wilks

[57] ABSTRACT

Grooves can be detected on both sides of non-magnetic materials, preferably in terry fabric, carpets, blankets, or the like. A sensor is provided, which can be either inductive or capacitive, and is positioned on one side of the material opposite a rotatable and movable follower or finger on the other side. The finger is preferably made of ferromagnetic material and is resiliently biased towards and in contact with one surface of a material such as terry fabric. The sensor continuously monitors the distance between the finger and a reference point and generates a signal when a change in such distance occurs.

7 Claims, 3 Drawing Sheets

METHOD AND APPARATUS FOR DETECTING SURFACE DISCONTINUITIES

FIELD OF THE INVENTION

The invention relates to methods and devices for detecting surface discontinuities and particularly to techniques for detecting bands of transverse areas of greater or lesser thickness in the surface of non-magnetic materials.

BACKGROUND OF THE INVENTION

A particularly desirable use of the present invention is in connection with the production of textile items made from terry cloth.

Terry fabric is produced by automatic machines and is supplied in rolls or spools containing rolled lengths of fabric which may be several hundred meters long. Each roll consists of multiple segments of plush surface of tufted fabric which are separated by grooves of untufted bands. Each segment may have design features incorporated on its surface such as printed pattern or decorative grooves an marks, which are according to buyer's taste and fashion demands. Although the designer intention is to have uniform segments, the length and the shape of segments within the roll may vary considerably according to stretching force, dyeing process, humidity and elasticity of treads.

In the past apparatus have been built and used for detection of a change in thickness of the terry fabric. A typical illustration of such apparatus can be found in U.S. Pat. No. 3,182,147. The apparatus includes two double-arm levers, each of which is mounted to a shaft. A sensing arm of a lower lever slides on the surface of the fabric and its motion is mechanically multiplied by the upper lever. The magnified motion activates a mechanical switch which provides an electrical connection. A similar prior apparatus but with one double-arm lever is disclosed in U.S. Pat. No. 4,375,175.

Another prior type of sensing device is disclosed in U.S. Pat. No. 4,187,132. This device uses mechanical scanners which are movable in vertical direction under the influence of the differences in height level of the fabric moving below. The scanners close an electrical contact when they detect a groove.

Such prior devices have sensing arms mounted rotatably to a shaft and do not have means to distinguish between small irregularities in the fabric thickness, such as a knot or a thicker thread, and therefore often incur false readings. In addition, prolonged use of such sensing arms results in recurring misalignment and the need for frequent adjustment.

The terry fabric has usually symmetrical grooves on both sides which are stretched during the sensing process. In case of narrow symmetrical grooves, the tension may be high and the groove on one side may not contact the base plate of the prior type of machine. In such circumstances the prior devices will not be able to sense the groove. This can be a serious problem, since the depth of a groove may be as small as 0.14 millimeter and therefore not detectable by the prior devices. If a strong spring is used to ensure contact of the sensing finger with the terry fabric, its pressure may crush the terry and cause false readings. Therefore, the stretching devices available heretofore have not provided reliable means to detect grooves in terry fabric.

Another prior apparatus is disclosed in U.S. Pat. No. 3,182,536 which discloses the use of two rollers mounted on opposite sides of the terry fabric. When a groove comes between the rollers, they get closer, and the change in their mutual position is transmitted through a set of levers which intercept a light beam to represent the presence of the groove. The apparatus is large and has a considerable mechanical inertia. In addition, it is not applicable to detection of narrow grooves because it uses long rollers which cannot engage narrow grooves which have been distorted by web or weft bias in the fabric.

Another prior apparatus is disclosed in U.S. Pat. No. 2,637,115. That apparatus includes a permanent magnet which is positioned on one side of a non-magnetic material and a movable ferromagnetic piece of metal which is positioned on the other side. The piece of metal is attracted by the magnet and the change in its position is proportional to the thickness of the material. A signal corresponding to the change in thickness is produced by a mechanical switch which is connected to the movable finger. This system is not sensitive enough for detection of small grooves in terry fabric because of the mechanical hysteresis of the switch.

Another prior apparatus is disclosed in the U.S. Pat. No. 4,364,502. That patent discloses a rotating set of magnetic sensors which detect the position of a ferromagnetic line in a web of material to be cut. That method is applied to cut a long piece of carpet which contains a line of ferromagnetic iron oxide or iron powder in its surface. A similar prior method of sensing a ferromagnetic line in fabric is disclosed in U.S. Pat. No. 4,493,234. However, terry fabric and many other non-magnetic materials do not have ferromagnetic material incorporated in the surface and, therefore, such methods are not applicable.

Another prior apparatus is disclosed in the U.S. Pat. No. 3,553,668. That apparatus uses a change of capacitive or inductive properties between two plates to detect irregularities in the thickness of a moving web. The plates are attached to rollers which are in contact with the web. If a local surface elevation passes under one of the rollers, it produces a mutual displacement between the rollers which changes capacitive and inductive properties between the plates. However, there is no mutual displacement if all rollers sink into a groove simultaneously. For that reason this method is not applicable for detection of grooves in terry fabric.

Another prior method incorporates a light beam for detection of thickness. The light beam is emitted by a light transmitter and directed through the material towards a light receiver. A thin band of untufted fabric lets the beam go through, while the thicker plush part stops it. However, this method is likely to provide an inaccurate signal if applied to terry fabric because the tufted surface of terry cloth has openings through which the light beam can penetrate and the untufted bands are often dense enough to stop such a light beam.

Although, it has been recognized heretofore that it is desirable to automate the work stations for terry fabric, only the towel terry without grooves or with relatively wide grooves has been cut into segments by means of automatic machines. Terry fabric with narrow grooves, usually less than 6 millimeters, has heretofore been cut by hand because of the difficulties of detecting narrow grooves and eliminating the bias in the fabric. The worker had to move the terry fabric along a table, locate a groove between plush areas and then cut the fabric in the middle of the groove using a rotatable cutting disk. This is a slow and unsafe operation which requires skilled labor. In addition, the manual cutting quite often results in improper cuts because of the difficulty of cutting exactly in the middle of a distorted and narrow groove.

Accordingly, it is a principal object of the present invention to provide a method and apparatus for detecting surface discontinuities in non-magnetic material such as the transverse untufted bands or grooves of terry cloth, irrespective of the relative width of such discontinuites.

Another object of the present invention is to provide a reliable and cost-effective means for detecting the untufted bands or grooves of fabric such as terry fabric.

Still another object of the present invention is to provide a method and apparatus for detecting surface discontinuities and which can be employed as an integral part of a control system in any automated machine which processes non-magnetic material.

A further object of the present invention is to provide a method and apparatus for detecting surface irregularities and which may be employed in connection with automated fabric stretching equipment of the type described in my co-pending application Ser. No. 07/176,423. The text of said application is incorporated herein by reference.

SUMMARY OF THE INVENTION

In the present invention, a sensing device reliably detects a change in the topography of the surface of a non-magnetic work piece, especially changes in the thickness of terry fabric and may be used to detect both wide and narrow grooves in such fabric, so as to permit a more versatile and rapid automatic operation. The present sensing device provides means for ensuring a consistent position of the cutting line for terry fabric and, therefore, automation of the process of cutting the fabric into independent segments.

In the present sensing device, a preferably ferromagnetic spring biased finger slides continuously along the surface of the moving material such as terry fabric and presses the fabric against a rib-like structure which is located on the opposite side of the fabric from the finger. A sensor, which is sensitive to the proximity of the ferromagnetic finger is located diametrically opposite the finger and the fabric is transported between the sensor and the finger. When the thickness of the transported fabric changes, that is for example, when an untufted band or groove of terry fabric comes between the finger and the ribs, the finger moves inwardly. The sensor detects a change in the distance between it and the finger and a suitable signal representative of the presence of the untufted groove is generated.

BRIEF DESCRIPTION OF THE DRAWINGS

For a further understanding of the present invention, reference may be had to the accompanying drawings, in which.

BRIEF DESCRIPTION OF THE PREFERRED EMBODIMENTS

Figure 1:
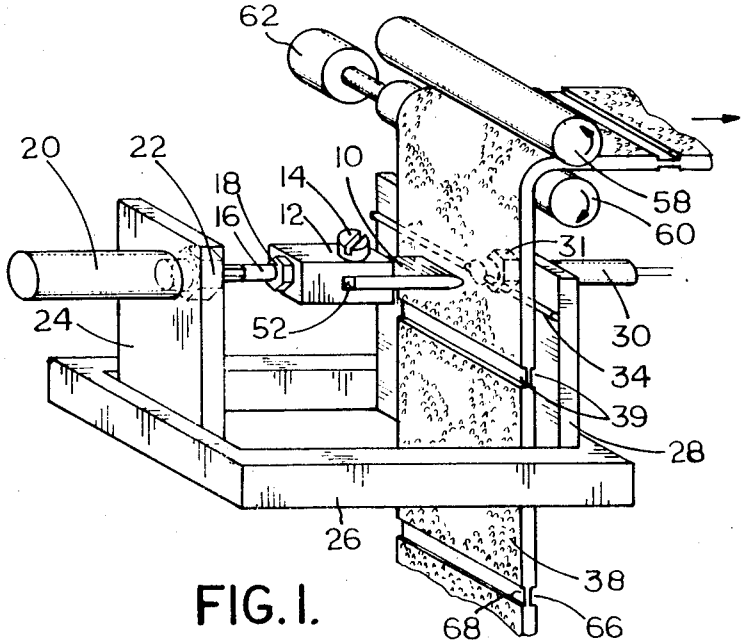
FIG. 1 is a perspective view of a preferred embodiment of sensing apparatus, showing the elements in their operating positions according to the present invention.

Referring now to the drawings, and in particular to FIG. 1, the preferred sensing apparatus is shown with the elements in their operating position. A surface following or sensing finger 10, preferably made of a metallic material, is pivotally mounted to a rod clevis 12 using a pivot pin 14. The rod clevis 12 is screwed on a non-rotating actuator rod 16 and its position is secured by a nut 18. The non-rotating rod 16 is a part of an actuator 20, preferably a reverse single acting pneumatic cylinder, which is normally extended by means of a spring and withdrawn by means of an external air pressure. The spring is an inside part of the the actuator 20 and it is not shown in the drawings. The actuator 20 is permanently attached to a plate 24 with a nut 22. The plate 24 and a plate 28 are mounted to a frame 26.

A high sensitivity sensor 30, preferably an inductive, magnetic or capacitive proximity switch of the type produced and sold by Omron Company, is mounted on one side of a support plate 28 which is also mounted on the frame 26. The plate 28 may be provided with a hole 32, seen best in FIG. 2. In the present embodiment, the sensor 30 is screwed into the hole 32 and fixed by a nut 31 in a position calibrated to the thickness of the material being surveyed. Alternatively, the sensor may be mounted directly behind and substantially concentrically with the hole 32. For maximum sensitivity the finger 10 is mounted so that its longitudinal axis is substantially concentric with the hole 32. At present, inductive proximity sensors which are available in the market can detect movement of metal equal approximately to 0.02 millimeter. It should be understood that the plate 28 need not be provided with the hole 32 if it is made of a suitable non-conductive material. The inductive proximity switch or sensor 30 will function properly from behind the plate without the hole 32 if the plate is non-conductive. Under such circumstances it is within the skill of the art to select an appropriate mounting means for the sensor. The use of the hole 32 has been found convenient and desirable irrespective of the material of the plate 28.

Figure 2:
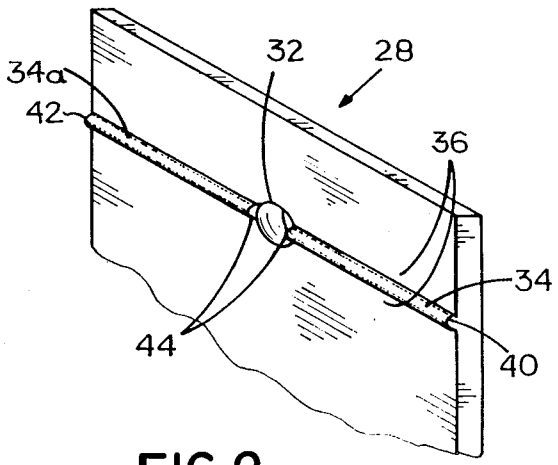
FIG. 2 is a perspective view of a portion of the sensor plate according to the present invention.

The plate 28 may be provided with a pair of thin ribs or bars 34 and **34*a* which extend in opposite directions away from the hole 32 along a common diameter thereof in the plane of the plate 28, as seen best in FIG. 2. It should be understood that the plate 28 as depicted in FIG. 2** is designed for use in connection with equipment adapted for surveying fabric materials, especially terry fabric. The scope of the present invention is not to be limited by the particular type of material being surveyed, and is described herein as adapted for terry fabric by way of convenience only.

The ribs 34 and **34*a* are selected to protrude outwardly from the plane of the plate 28 by a distance which is only slightly larger than the depth of the deepest surface irregularity or untufted band or groove in terry fabric 38** expected to be encountered.

FIG. 2 shows in detail the shape and position of the ribs 34 and 34*a* according to the present invention. The ribs 34 and 34*a* may be made from the same material as the plate 28 and formed by milling the surface of the plate 28 and leaving the ribs 34 and 34*a*. Another way of making the ribs would be to attach a pair of straight and suitably dimensioned wires to the plate 28 by means of a quantity of solder 36. Other techniques known to those skilled in the art for forming the ribs 34 and 34*a* may be used without departing from the scope of the invention. The ribs 34 and 34*a* are preferably metal material but may be made from any appropriate material, as desired. It should be understood that if the ribs 34,34*a* are made from non-magnetic material such as plastics, which are invisible to the sensor 30, they may extend across the hole 32, as desired. Ribs made of magnetic materials including metal or ferromagnetic materials must be positioned so as not to interfere with the operation of the sensor 30.

Figure 3:
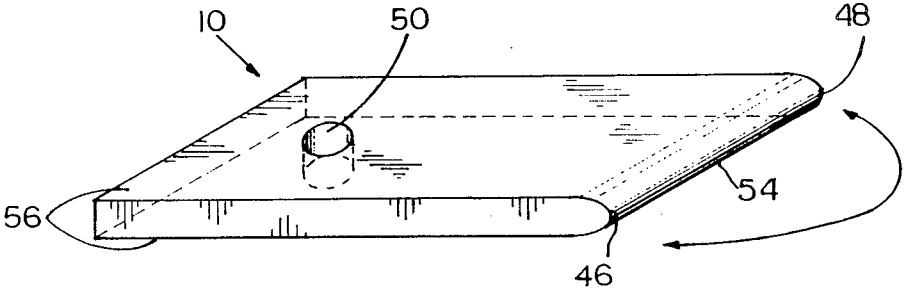
FIG. 3 is a perspective view of a surface follower or finger according to the present invention.

The ribs 34,34*a* are oriented on a common axis which is substantially perpendicular to the direction of transport of the terry fabric 38 through the work station. The total longitudinal length of the ribs 34 and 34*a* taken together may vary but is preferably such that each rib extends from the edge of the hole 32 at least to a point where it reaches beyond its corresponding side edge of the finger 10. That is, the distance between the distal ends 40 and 42 of the ribs should not be less than the distance between the edges 46 and 48 of the finger 10 as seen in FIG. 3. It is preferred in the present embodiment that the ends 40 and 42 exceed the width of the terry fabric 38, so that they do not catch threads. The diametrically opposed proximal ends 44 of the ribs 34 and 34*a* should be somewhat smoothly shaped or slightly rounded so as not to catch threads as well.

One embodiment of the finger 10 is shown in FIG. 3 in which the finger 10 includes a pivot hole 50 having a diameter slightly larger than the diameter of the pivot pin 14 whereby the finger 10 is free to pivot laterally around a pivot axis defined by the pin 14. A proper use of the present apparatus requires the back edge of the finger 10 to be spaced by a predetermined amount, indicated in FIG. 1 by reference numeral 52, from the inside part of the rod clevis 12. Such spacing allows for relatively small pivoting or swivel action of the finger around the pivot pin 14 and ensures continuous contact of the front edge 54 of the finger 10 with the terry fabric 38. For ease of rotation within the clevis 12 the upper and the lower surfaces 56 of the finger 10 are preferably polished to minimize friction. The side edges 46 and 48 of the finger 10 should be somewhat rounded, as is the fabric contacting edge 54, so as not to catch threads of the fabric pile.

While the preferred embodiment puts an emphasis on the relatively small pivotal or swivel action of the movable finger 10 for the sake of sensitivity of the present apparatus, it will be understood by those skilled in the art that such requirement is necessary only in the case of a slight variation in thickness of tufted and untufted bands of the terry fabric 38. in the applications where the variation is large, the present embodiments does not require such pivoting action in the finger 10. In such instances the finger 10 and the rod clevis 12 can be made from one piece of material.

Figure 5:
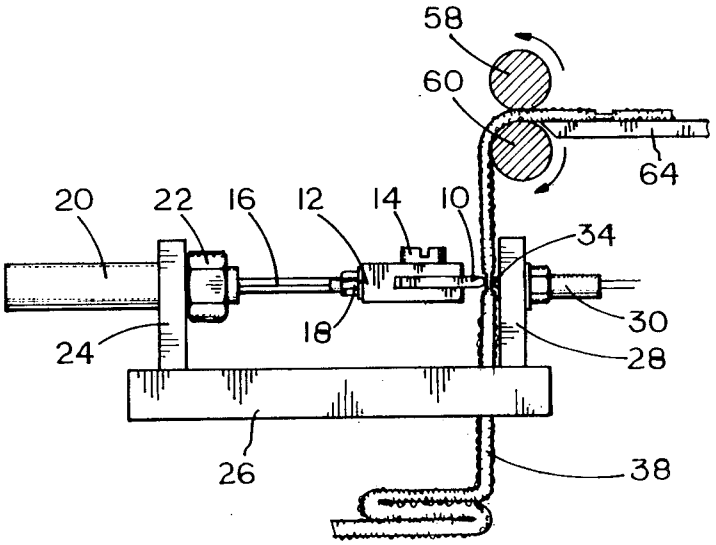
FIG. 5 is a side view of another operating position of the sensing apparatus of FIG. 1.
Figure 4:
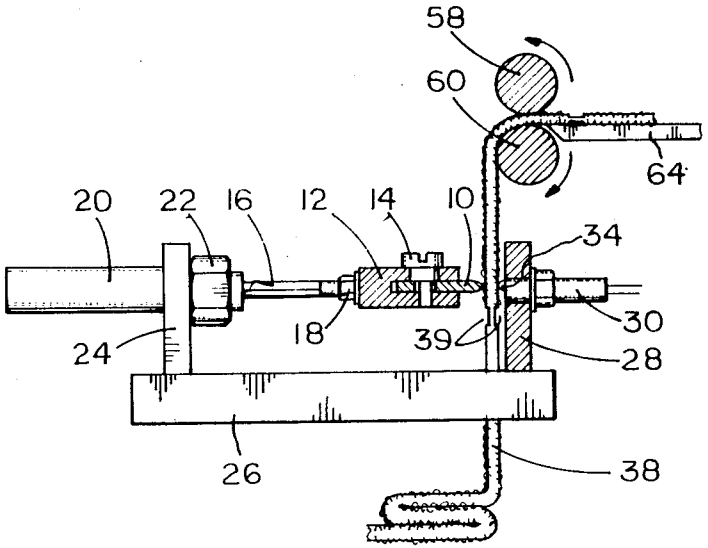
FIG. 4 is a side view of an operating position of the preferred sensing apparatus of FIG. 1.

As shown in FIGS. 4 and 5, the terry fabric 38 is transported through the work station by two rollers 58 and 60 which are driven by a motor 62 (FIG. 1). After passing through the drive rollers 58 and 60, the fabric is guided toward the next work station, which may be a clamping or cutting station, by a suitable platform member 64. The position of the roller 60 in reference to the position of the plate 28 should be such that the terry fabric 38 lens against the ribs 34 and 34*a* at every stage of operation. Such position ensures that the variable tension in the terry fabric 38 never pushes the finger 10 away.

FIG. 4 shows a detailed side view of the sensing apparatus when the finger 10 is moved forward and rides on or presses lightly against the plush tufted surface of the terry fabric 38 so as to follow or feel the surface topography of the moving fabric. The contact between the finger 10 and the terry fabric 38 is ensured by a spring, not shown on the drawings, which is located inside the actuator 20 and applies a constant force to the finger and clevis assembly tending to retain the finger in surface-following contact with the fabric. When there is no fabric groove between the finger 10 and the sensor 30, the distance between the finger 10 and the sensor remains generally constant and the sensor 30, does not generate an actuation signal.

When an untufted band or groove 39 comes in front of the finger 10, the finger 10 slides into the groove 39 and the distance between the finger 10 and the sensor 30 becomes smaller. FIG. 5 shows a detailed side view when the finger 30 has been moved forward and presses the groove 39 of untufted bands of the terry fabric against the ribs 34 and 34*a*. The sensor detects the close presence of the finger and the resulting actuation signal is representative of the presence of the groove 39.

It will be understood that the apparatus of the present invention also provides a reliable signal when the terry fabric 38 has grooves on one side only. If a groove 66 on the side of the fabric facing the plate 28 (FIG. 1) comes in front of the ribs 34 and 34*a*, the ribs slide into the groove and the distance between the finger 10 and the sensor 30 becomes smaller. If a groove 68 on the side of the fabric facing the finger 10 (FIG. 1) comes in front of the finger 10, the finger 10 slides into the grooves 68, and the distance between the finger 10 and the sensor 30 becomes smaller. In either case, the sensor detects the close presence of the finger 10 and thereby the presence of the groove. When grooves 39 are symmetrically located on both sides of the terry fabric, the change of distance between the finger 10 and the sensor 30 becomes accordingly greater, thus providing a reliable signal to a machine which cuts the terry fabric 38 into individual segments. The finger 10 can be disengaged and held out of contact with the fabric 38 by supplying an appropriate air pressure to the pneumatic cylinder 20, thus providing a desirable feature to automate the process of loading a new piece of fabric 38. The finger 10 will engage the fabric 38 by means of the internal spring after the air pressure is removed.

Figure 6:
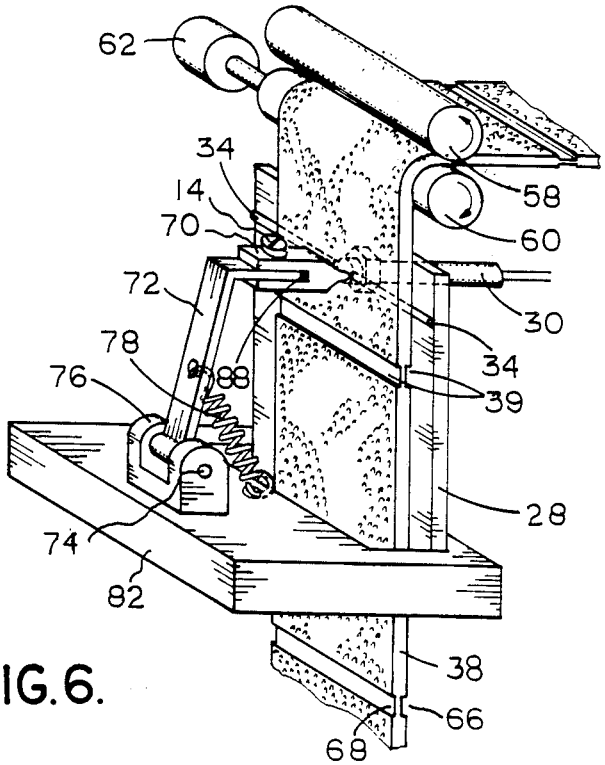
FIG. 6 is a perspective view of another embodiment of a sensing apparatus according to the present invention.

FIG. 6 is detailed perspective view of an alternate embodiment of a sensing apparatus according to the invention in which the elements of the work station are depicted in their operating position. A sensing finger 70, preferably made of a ferromagnetic metal, is pivotally mounted to an arm 72 by a pin 14. In this embodiment the finger 70 is formed as a clevis into which a section of the arm 72 is fitted and pivotally retained by the pin 14. The finger 70 pivots or swivels through a limited angle around the axis of the pin 14.

In this embodiment, the arm 72 is pivotally mounted about an axis defined by a pivot shaft 74 which is orthogonal to the pivot axis of the finger 70, and which may be horizontal in fact. It should be understood however that the present invention is not limited by the orientation of the equipment in which it is embodied. The fabric 38 need not move vertically through the machine as shown, such orientation only being used for ease of illustration.

The pivot shaft 74 is mounted in a suitable bracket 76 attached to a frame 82. The contact between the finger 70 and the terry fabric 38 is ensured by a spring 78 which applies a constant bias to the arm 72 in a direction toward the fabric 38.

In this embodiment, it is preferred that the ribs 34, 34*a* extend from the edges of the hole 32 to points beyond the total width of the finger 70. That is, the distance between the ends 40 and 42 of the ribs 34, 34*a* should be not less than the distance between the ends 84 and 86 of the finger 70, as shown in FIG. 7.

Figure 7:
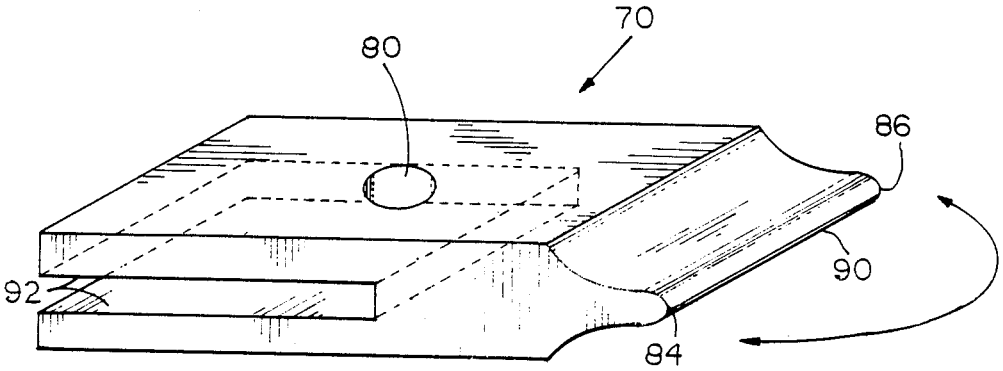
FIG. 7 is a perspective view of a surface follower or finger for use in the device shown in FIG. 6.

FIGS. 6 and 7 show the finger 70 which includes a pivot hole 80 having a diameter slightly larger than the diameter of the pivot pin 14. A proper use of the present apparatus requires a suitable interstice 88 between the front of the arm 72 and the inside part of the finger 70, which allows for a relatively small pivot or swivel action of the finger 70 around the axis of the pin 14 and pivot hole 80 and ensures continuous contact of the front of fabric contacting edge 90 of the finger 70 with the terry fabric 38. For ease of movement relative to the arm 72 the inside surfaces 92 should be polished to minimize friction. The edges 84 and 86 of the finger 70 should be smooth so as not to catch threads of the fabric. The fabric contacting edge 90 is preferably rounded as shown in FIG. 7, so as to slide easily along the tufted pile.

While the finger 70 is described as having a pivot or swivel action for the sake of sensitivity, it will be understood by those skilled in the art that such requirement is necessary only in the case where the thickness of tufted and untufted bands of the terry fabric 38 varies slightly. In the applications where such thickness variation is large, the present embodiment does not require that the finger 70 pivot or swivel. In such instances the finger 70 and arm 72 can be made from one piece of material, as desired.

As described above in connection with the principal embodiment, the embodiment of FIGS. 6 and 7 also provides a reliable signal when the terry fabric 38 has grooves on one side only. If a groove 66 comes in front of the ribs 34, 34*a*, the ribs slide into the groove 66 and the distance between the finger 70 and the sensor 30 becomes smaller. If a groove 68 comes in front of the finger 70, the finger 70 slides into the groove 68, and the distance between the finger 70 and the sensor 30 becomes smaller. In either case, the sensor detects the close presence of the finger 70 and thereby detects the presence of the groove as described above. When grooves 39 are symmetrically located on both sides of the terry fabric, the change of distance between the finger 70 and the sensor 30 becomes accordingly greater, thus providing reliable signal to a machine which cuts the terry fabric 38 into individual segments.

Figure 8:
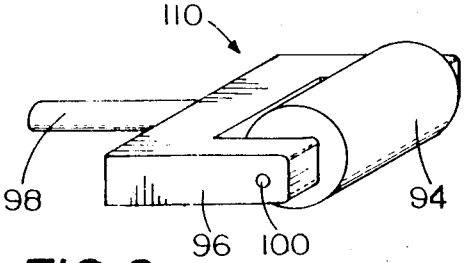
FIG. 8 is a perspective view of another embodiment of the surface follower of the present invention.

Referring now to FIG. 8, there is shown an alternate embodiment of the finger follower 10 in accordance with the present invention. In this embodiment, a roller follower 110 comprises a roller member 94 rotatably mounted about shaft 100 to a rod clevis 96. The clevis 96 is, in turn, affixed to a suitable actuator rod 98, of the type described hereinabove. It will be understood that the roller follower 110 may be utilized with a pivotally mounted support arm 72 as shown in FIG. 6. The roller follower 110 may be used on a variety of fabrics but has been found to be particularly useful for use in connection with long haired fabrics such as certain types of carpet material and the like. In such a case, the lateral edges of the clevis should be smooth or somewhat rounded in order to minimize their being caught up in threads of the material.

Although the invention has been described in connection with one or more specific embodiments, it should be understood that modifications may be made by persons skilled in the art without departing from the invention, the scope of which is measured by the following claims:

What is claimed is:

1. In a machine having a frame and a sensing device mounted on the frame for providing a signal in the presence of a surface discontinuity in fabric transported through the device, the improvement comprising:

a. a metallic fabric follower positioned on one surface of the fabric;

b. means for biasing the follower toward the fabric;

c. sensing means for monitoring the distance between itself and said follower and providing a signal when said distance changes.

2. The machine of claim 1 comprising, in addition, a slide plate in contact with the other surface of the fabric directly opposite said follower, said follower being resiliently biased toward said slide plate thereby to press the fabric against said slide plate.

3. The machine of claim 2 in which said follower comprises a finger element having a rounded lineal edge to engage said one surface of the fabric.

4. The machine of claim 3 in which said slide plate has a rounded lineal protrusion to engage said other surface at a point directly opposite said rounded lineal edge of said follower.

5. The machine of claim 4 in which said rounded lineal protrusion of said slide plate is at least as long as the rounded lineal edge of said follower.

6. A method for detecting surface discontinuities in a non-magnetic material, comprising the steps of:

transporting the material past a work station;

resiliently biasing a metallic follower against one surface of the moving material;

continuously monitoring the distance between said follower and a reference point; and generating a signal when any change occurs in said monitored distance.

7. The method of claim 6 in which said non-magnetic material is terry fabric.

* * * * *